US010241465B2

(12) United States Patent
Naganuma et al.

(10) Patent No.: US 10,241,465 B2
(45) Date of Patent: Mar. 26, 2019

(54) OPENING AND CLOSING MECHANISM AND IMAGE FORMING APPARATUS

(71) Applicant: FUJI XEROX CO., LTD., Tokyo (JP)

(72) Inventors: Teruki Naganuma, Yokohama (JP); Toshikazu Takubo, Yokohama (JP); Kohei Takahashi, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/593,709

(22) Filed: May 12, 2017

(65) Prior Publication Data

US 2018/0088521 A1 Mar. 29, 2018

(30) Foreign Application Priority Data

Sep. 26, 2016 (JP) ..... 2016-186782
Sep. 26, 2016 (JP) ..... 2016-186783

(51) Int. Cl.
*G03G 21/00* (2006.01)
*G03G 21/16* (2006.01)

(52) U.S. Cl.
CPC ..... *G03G 21/1638* (2013.01); *G03G 21/1633* (2013.01); *G03G 2221/1687* (2013.01)

(58) Field of Classification Search
CPC ..... G03G 21/1638; G03G 2221/1687
See application file for complete search history.

(56) References Cited

U.S. PATENT DOCUMENTS

2003/0210106 A1 11/2003 Cheng et al.
2005/0018234 A1* 1/2005 Lee ..... G03G 15/70 358/1.14
2005/0040583 A1* 2/2005 Murakami ..... G03G 15/232 271/65
2005/0116683 A1 6/2005 Cheng et al.
2005/0135122 A1 6/2005 Cheng et al.
2005/0140482 A1 6/2005 Cheng et al.
2006/0029425 A1* 2/2006 Tomatsu ..... G03G 21/1633 399/125
2006/0061323 A1 3/2006 Cheng et al.
2006/0076922 A1 4/2006 Cheng et al.
2006/0104665 A1* 5/2006 Koshida ..... G03G 21/1638 399/124
2007/0092292 A1* 4/2007 Ito ..... G03G 21/1638 399/124
2007/0177892 A1* 8/2007 Ikebata ..... G03G 21/1628 399/107

(Continued)

FOREIGN PATENT DOCUMENTS

JP H05-208737 A 8/1993
JP 2011-53281 A 3/2011

*Primary Examiner* — David J Bolduc
(74) *Attorney, Agent, or Firm* — Oliff PLC

(57) ABSTRACT

An opening and closing mechanism includes: an opening and closing door that is supported rotatably so as to be movable between a closed position where to close an opening of an apparatus body and an open position where to open the opening; a link member that is supported rotatably by a rotary shaft that is attached to the apparatus body; a guide member having a first guide surface that moves being kept in contact with the link member when the opening and closing door is moved toward the closed position and a second guide surface that moves being kept in contact with the link member when the opening and closing door is moved toward the open position; and a switching member that guides the link member from the first guide surface and the second guide surface.

15 Claims, 8 Drawing Sheets

(56) References Cited

U.S. PATENT DOCUMENTS

| | | | | |
|---|---|---|---|---|
| 2008/0240780 | A1* | 10/2008 | Yamauchi | G03G 21/1633 399/121 |
| 2009/0096414 | A1 | 4/2009 | Cheng et al. | |
| 2009/0189565 | A1 | 7/2009 | Cheng et al. | |
| 2009/0190954 | A1* | 7/2009 | Okabe | G03G 15/161 399/111 |
| 2010/0078884 | A1* | 4/2010 | Uehara | G03G 21/1633 271/314 |
| 2010/0219791 | A1 | 9/2010 | Cheng et al. | |
| 2010/0254728 | A1* | 10/2010 | Iwase | G03G 15/2035 399/122 |
| 2010/0320963 | A1 | 12/2010 | Cheng et al. | |
| 2011/0052253 | A1* | 3/2011 | Nieda | E05C 19/02 399/110 |
| 2011/0233859 | A1* | 9/2011 | Watanabe | B65H 29/52 271/271 |
| 2013/0156463 | A1* | 6/2013 | Jung | G03G 21/1633 399/110 |
| 2014/0016962 | A1* | 1/2014 | Sato | G03G 21/1623 399/107 |
| 2014/0161488 | A1* | 6/2014 | Park | G03G 21/1633 399/124 |
| 2014/0212195 | A1* | 7/2014 | Aoyama | G03G 15/6529 399/405 |
| 2015/0130127 | A1* | 5/2015 | Saito | B65H 29/125 271/225 |
| 2016/0152427 | A1* | 6/2016 | Ishikawa | B65H 3/44 271/9.13 |
| 2016/0368723 | A1* | 12/2016 | Hayakawa | B65H 5/26 |
| 2017/0248899 | A1* | 8/2017 | Yamasaki | G03G 21/1633 |

* cited by examiner

OPENING AND CLOSING MECHANISM AND IMAGE FORMING APPARATUS

CROSS-REFERENCE TO RELATED APPLICATIONS

This application is based on and claims priority under 35 USC 119 from Japanese Patent Application No. 2016-186782 filed on Sep. 26, 2016 and Japanese Patent Application No. 2016-186783 filed on Sep. 26, 2016.

BACKGROUND

Technical Field

The present invention relates to an opening and closing mechanism and an image forming apparatus.

SUMMARY

According to an aspect of the invention, there is provided an opening and closing mechanism comprising: an opening and closing door that is supported rotatably so as to be movable between a closed position where to close an opening of an apparatus body and an open position where to open the opening; a link member that is supported rotatably by a rotary shaft that is attached to the apparatus body; a guide member having a first guide surface that moves being kept in contact with the link member when the opening and closing door is moved toward the closed position and a second guide surface that moves being kept in contact with the link member when the opening and closing door is moved toward the open position; and a switching member that guides the link member from the first guide surface and the second guide surface.

BRIEF DESCRIPTION OF THE DRAWINGS

Exemplary embodiments of the present invention will be described in detail based on the following figures, wherein.

DESCRIPTION OF SYMBOLS

Figure 1:
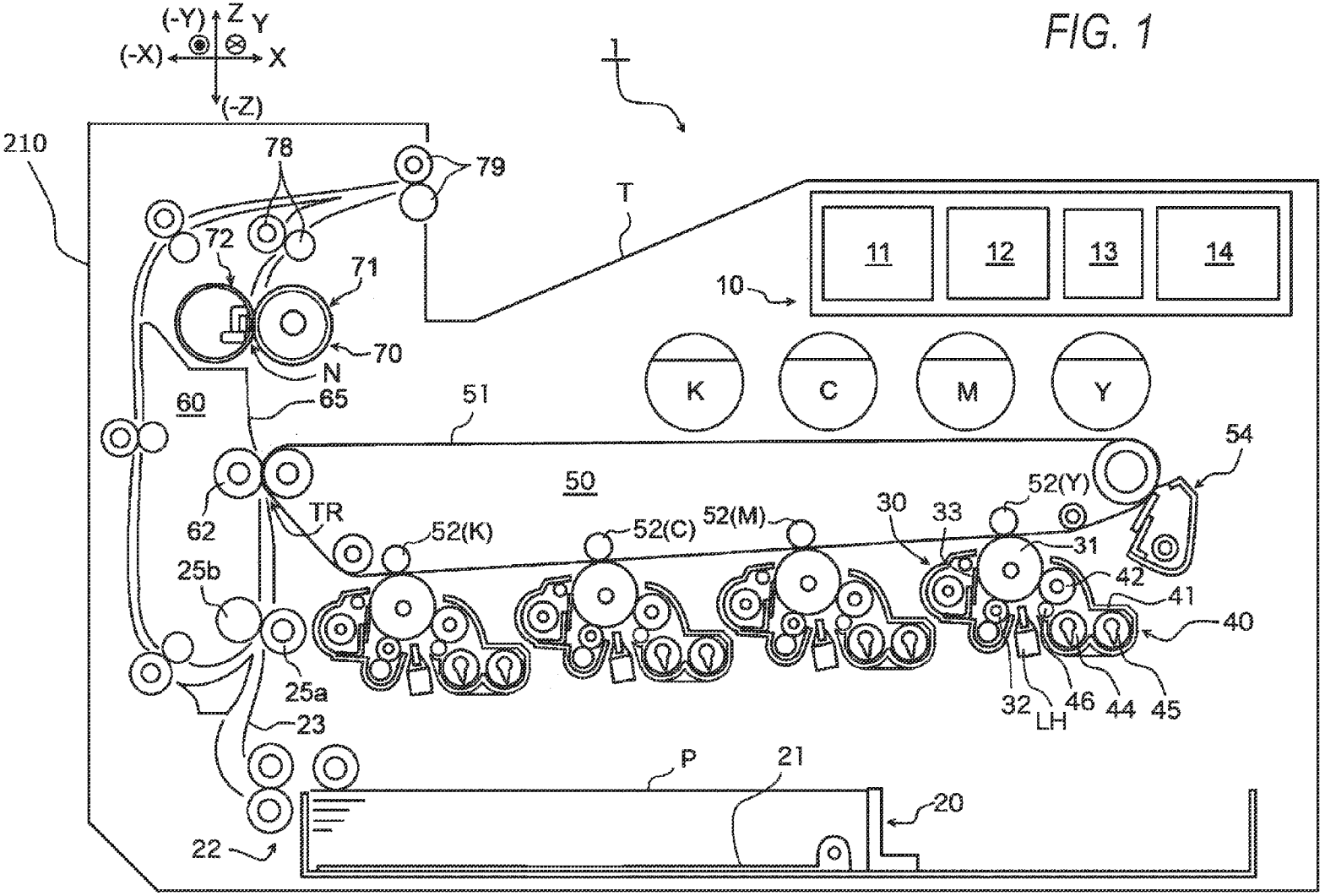
FIG. 1 is a schematic vertical sectional view showing the internal configuration of an image forming apparatus according to an exemplary embodiment.

1 . . . Image forming apparatus
10 . . . Control device
20 . . . Sheet supply device
25 . . . Registration roller pair
30 . . . Photoreceptor unit
40 . . . Development unit
50 . . . Transfer unit
60 . . . Sheet conveying unit
  610 . . . registration part
    611 . . . First sheet guide
    612 . . . Second sheet guide
  620 . . . Secondary transfer part
  630 . . . Flipping part
    631 . . . Inside conveyance guide
  62 . . . Secondary transfer roller
70 . . . Fusing unit
100 . . . Body
  103 . . . Lock pin
  104 . . . Rotary shaft
210 . . . Opening and closing door
  213 . . . Outside conveyance guide
  215 . . . Latch lever
  216 . . . Support shaft
  217 . . . Contact target member
220 . . . Guide member
  221 . . . First guide surface
  222 . . . Second guide surface
  223 . . . Third guide surface
230 . . . Switching unit
240 . . . Link member
  242 . . . Stud
250 . . . Tensile coil spring (link member 240)
260 . . . Tensile coil spring (guide member 220)
S . . . Compression coil spring (sheet conveying unit 60)

DETAILED DESCRIPTION

The present invention will be hereinafter described in detail with reference to the drawings using an exemplary embodiment and specific examples. However, the invention is not limited to the following exemplary embodiment and specific examples.

As for the following description that will be made with reference to the drawings, it is noted that the drawings are schematic ones and ratios between dimensions, for example, are different from real ones. And members other than ones that are necessary for the description are omitted in the drawings as appropriate, to facilitate understanding.

To facilitate understanding of the following description, in the drawings the front-rear direction, the left-right direction, and the top-bottom direction will be referred to as an X-axis direction, a Y-axis direction, and a Z-axis direction, respectively.

(1) Overall Configuration and Operation of Image Forming Apparatus

FIG. 1 is a schematic vertical sectional view showing the internal configuration of an image forming apparatus 1 according to the exemplary embodiment. The overall configuration and the operation of the image forming apparatus 1 will be described below with reference to FIG. 1.

The image forming apparatus 1 is configured in such a manner that a control device 10, a sheet supply device 20, photoreceptor units 30, development units 40, a transfer unit 50, a sheet conveying unit 60, a fusing unit 70, etc. are disposed in a body 100. The top surface (i.e., the end surface in the Z direction) of the body 100 is formed with a sheet ejection tray T to and on which image-recorded sheets are ejected and stacked. An opening and closing door 210 for exposing the inside of the image forming apparatus 1 to remove a jammed sheet P, carry out an inspection, or do some other work is supported rotatably by a front end portion (i.e., an end portion in the −X direction) of the body 100.

The control device 10 is equipped with an image forming apparatus controller 11 for controlling the operation of the image forming apparatus 1, a controller unit 12 for preparing image data corresponding to a printing request, an exposure controller 13 for controlling the lighting of exposure heads LH, a power source device 14, etc. The power source device 14 applies high voltages to charging rollers 32, development rollers 42, primary transfer rollers 52, a secondary transfer roller 62, etc. (described later) and supplies power to the exposure heads LH, the sheet supply device 20, and the fusing unit 70, sensors provided in the image forming apparatus 1.

The controller unit 12 converts printing information received from an external information sending apparatus (e.g., personal computer) into image information for latent image formation and outputs drive signals to the exposure heads LH with preset timing. Each of the exposure heads LH employed in the exemplary embodiment is an LED head in which plural light-emitting elements (light-emitting diodes (LEDs)) are arranged in line in the main scanning direction.

The sheet supply device 20 is disposed at the bottom of the image forming apparatus 1. The sheet supply device 20 is equipped with a sheet stacking plate 21 and a number of sheets P as recording media are stacked on the top surface of the sheet stacking plate 21. The top one of the sheets P stacked on the sheet stacking plate 21 is pulled out forward (in the −X direction) each time by a sheet pull-out unit 22 and conveyed, via a sheet guide 23, to a nip portion of a registration roller pair 25 which consists of a drive roller 25*a* and a driven roller 25*b*.

The photoreceptor units 30 are arranged in one direction above the sheet supply device 20 and equipped with respective photoreceptor drums 31. The charging roller 32, the exposure head LH, the development unit 40, the primary transfer roller 52, and a cleaning blade 33 are disposed in this order around each photoreceptor drum 31 in the circumferential direction.

The development unit 40 has a development housing 41 which houses a developer inside. In the development housing 41, the development roller 42 is opposed to the photoreceptor drum 31 and a pair of augers 44 and 45 for transporting developer toward the development roller 42 while stirring it are disposed in the bottom-rear of the development roller 42. A layer thickness restricting member 46 for restricting the thickness of a developer layer is disposed close to the development roller 42.

The development units 40, which are configured approximately in the same manner except for the developers housed in the development housings 41, form toner images of yellow (Y), magenta (M), cyan (C), and black (K), respectively.

The surface of the rotating photoreceptor drum 31 is charged by the charging roller 32 and is formed with an electrostatic latent image by latent image forming light that is emitted from the exposure head LH. The electrostatic latent image formed on the photoreceptor drum 31 is developed into a toner image by the development roller 42.

The transfer unit 50 is equipped with an intermediate transfer belt 51 onto which toner images of the respective colors formed on the photoreceptor drums 31 of the respective photoreceptor units 30 are transferred multiply and the primary transfer rollers 52 for sequentially transferring the toner images of the respective colors formed in the respective photoreceptor units 30 onto the intermediate transfer belt 51 (primary transfer). The transfer unit 50 is also equipped with an intermediate transfer belt cleaner 54 for removing residual toner that is stuck to the intermediate transfer belt 51.

The sheet conveying unit 60 is equipped with the driven roller 25*b* of the registration roller pair 25 which sends a sheet P conveyed from the sheet supply device 20 to a secondary transfer portion TR with the same timing as a secondary transfer while correcting the posture of the sheet P and a secondary transfer roller 62 for transferring together, onto the sheet P (recording medium), toner images of the respective colors that have been transferred onto the intermediate transfer belt 51 in superimposition (secondary transfer). The sheet P bearing the transferred toner images is guided by a conveyance guide 65 to a fusing nip portion N of the fusing unit 70.

Toner images of the respective colors formed on the photoreceptor drums 31 of the photoreceptor units 30 are transferred electrostatically onto the intermediate transfer belt 51 sequentially by the primary transfer rollers 52 to which prescribed transfer voltages are applied from, for example, the power supply device 14 being controlled by the image forming apparatus controller 11 (primary transfer), whereby a superimposed toner image of the toner images of the respective colors is formed.

As the intermediate transfer belt 51 is moved, the superimposed toner image on it is conveyed to the secondary transfer portion TR. A sheet P is supplied from the registration roller pair 25 with the same timing as the conveyance of the superimposed toner image to the secondary transfer portion TR.

A prescribed transfer voltage is applied from, for example, the power supply device 14 being controlled by the image forming apparatus controller 11 to the secondary transfer roller 62, and the superimposed toner image is transferred from the intermediate transfer belt 51 onto the sheet P that is sent from the registration roller pair 25 being guided by the sheet guide 23.

Residual toner on the surfaces of the photoreceptor drums 31 are removed by the cleaning blades 33 and collected into a toner collection container (not shown). The surfaces of the photoreceptor drums 31 are charged again by the charging rollers 32.

The fusing unit 30 is equipped with a heating module 71 and a pressing module 72, and the fusing nip portion N (fusing region) is formed by portions, pressed against each other, of the heating module 71 and the pressing module 72. The sheet P onto which the toner images were transferred at the secondary transfer portion TR is conveyed to the fusing unit 70 being guided by a conveyance guide 65 (in this state, the toner images have not been fused yet). In the fusing unit 70, the toner images on the sheet P are fused through heating and pressing by the heating module 71 and the pressing module 72.

The sheet P bearing the fused toner images is conveyed by a conveyance roller pair 78 and ejected from an ejection roller pair 79 to the sheet ejection tray T which is formed in the top surface of the body 100 of the image forming apparatus 1. Where double-sided printing is performed, the ejection roller pair 79 is driven in the reverse direction when the tail of the sheet P bearing the fused toner image on its front surface has passed the conveyance roller pair 78 and then conveyed to the registration roller pair 25 past a flipping conveyance passage which is formed in the opening and closing door 210. An image is thus formed on the back surface of the sheet P.

(2) Configuration and Operation of Sheet Conveying Part

Figure 2:
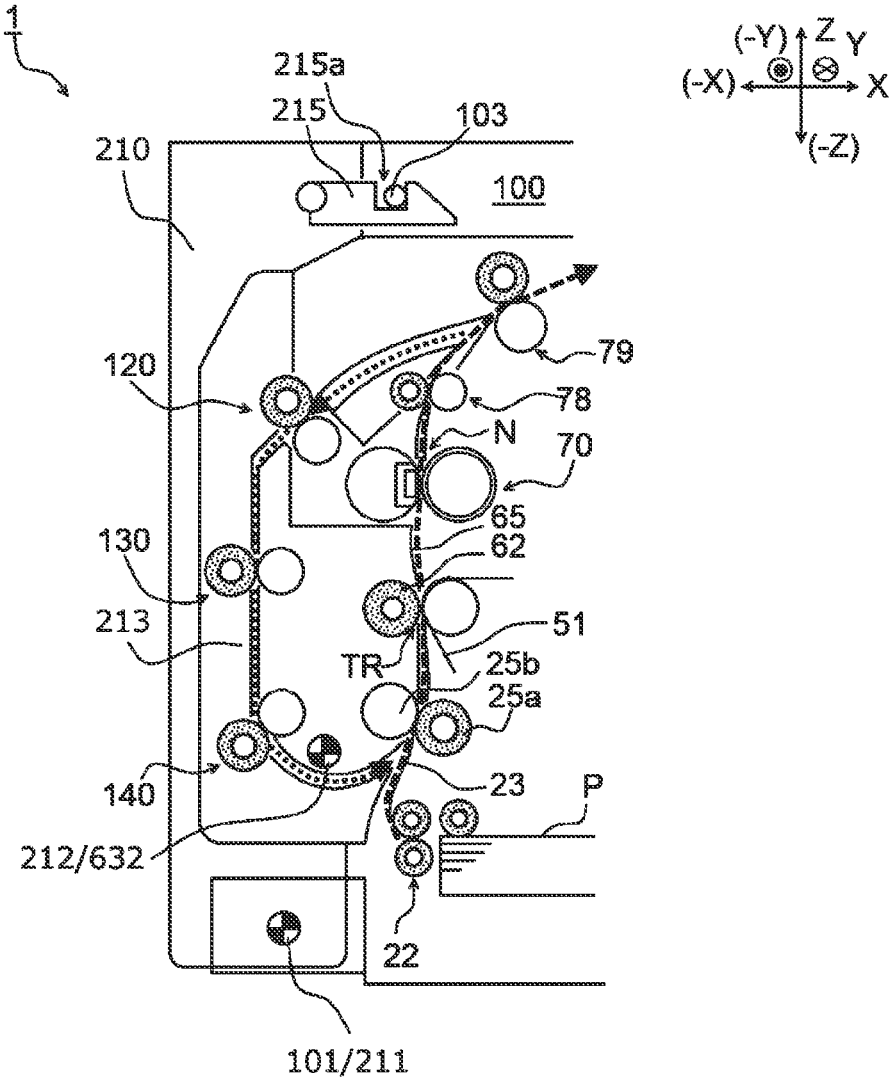
FIG. 2 is a schematic sectional view showing the internal configuration of a sheet conveying part and illustrating how a sheet is conveyed there.
Figure 3:
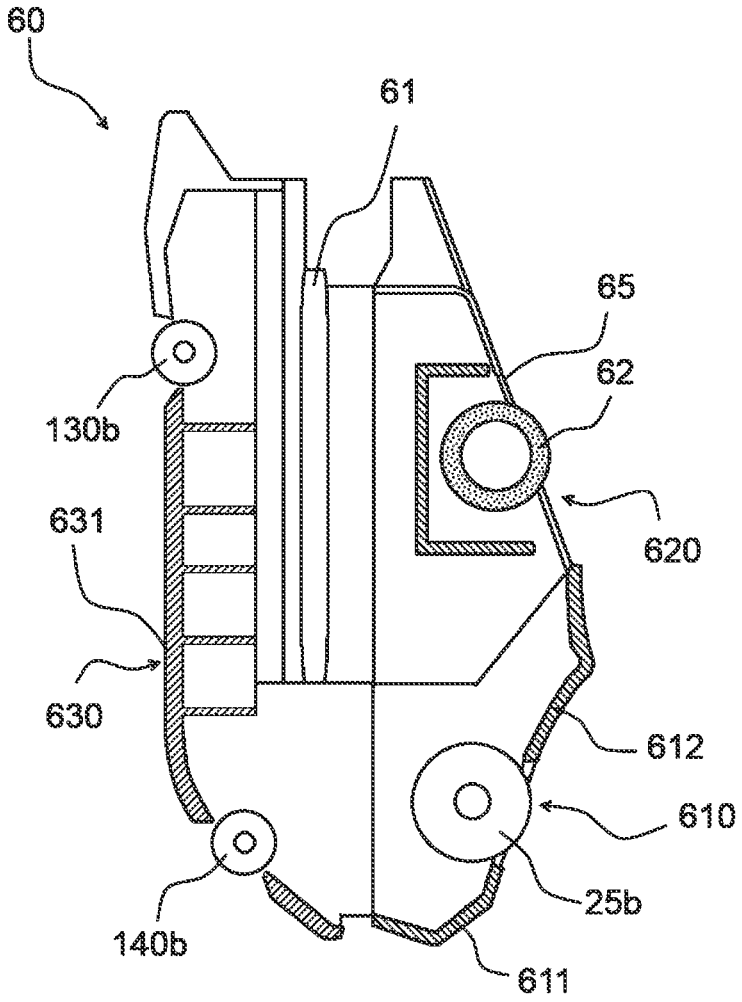
FIG. 3 is a schematic sectional view of a sheet conveying unit.
Figure 4A:
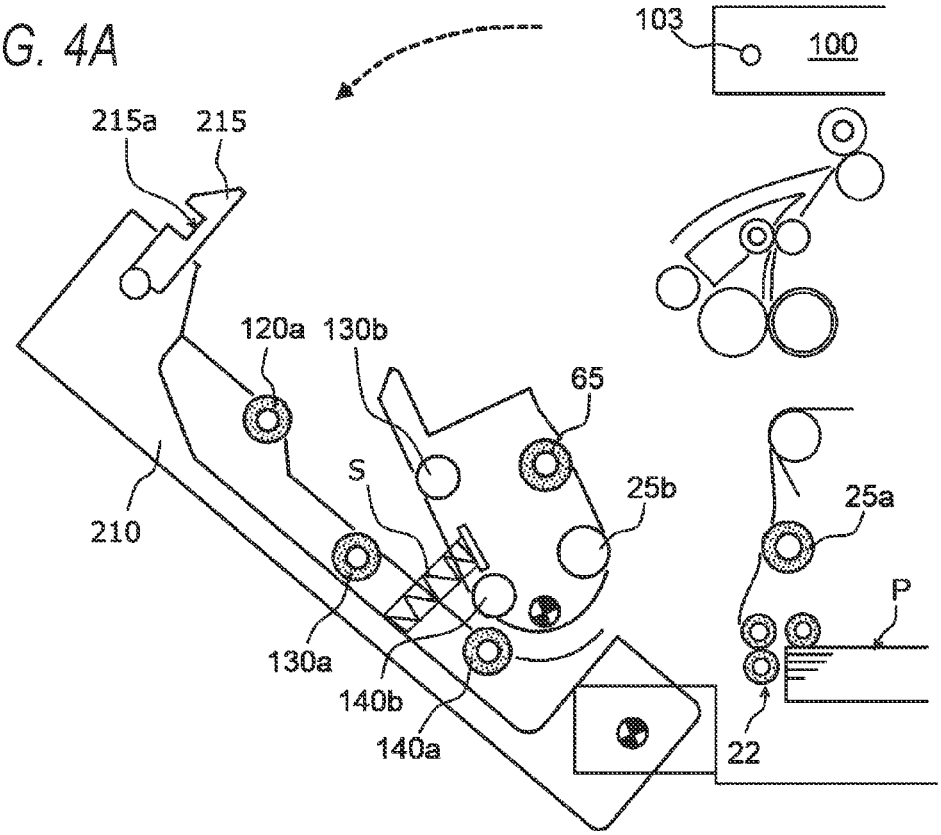
FIG. 4A is a schematic view showing a positional relationship between an opening and closing door and the sheet conveying unit in a state that the sheet conveying part is opened.
Figure 4B:
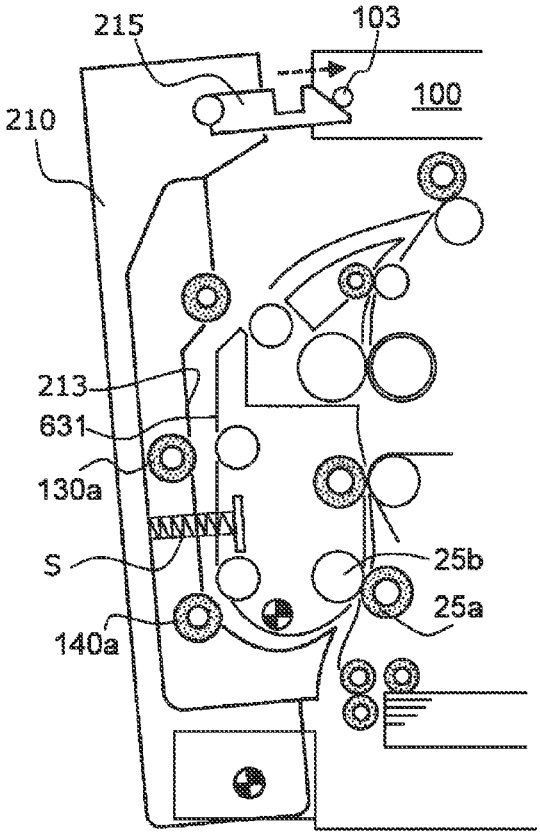
FIG. 4B is a schematic view of the sheet conveying part illustrating how the sheet conveying unit is moved in closing the opening and closing door.
Figure 5A:
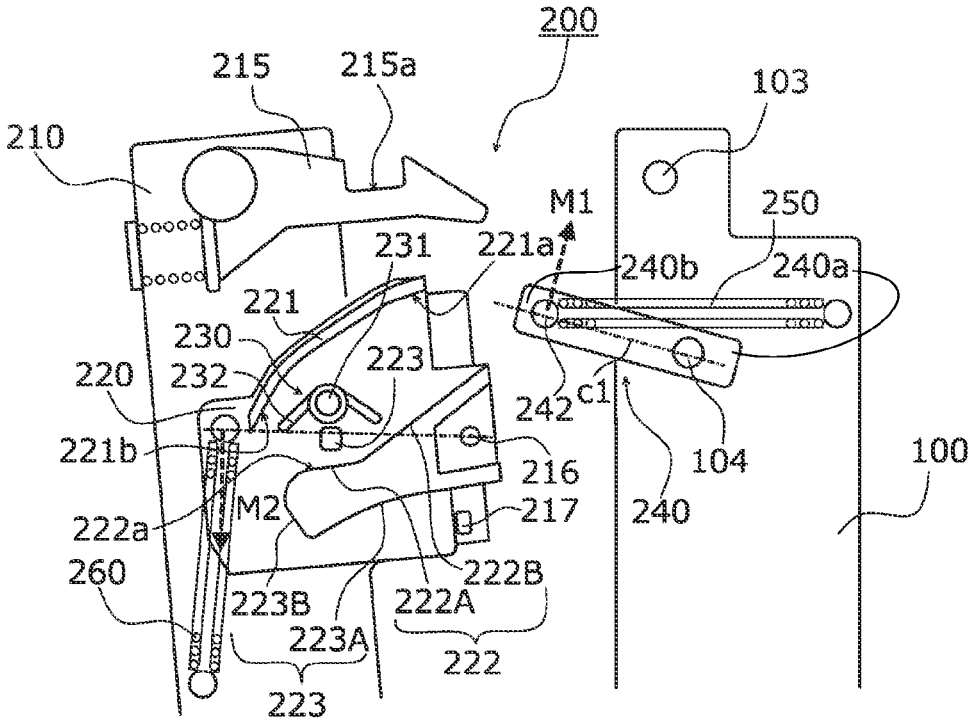
FIG. 5A is a schematic view showing the configuration of an opening and closing mechanism.
Figure 5B:
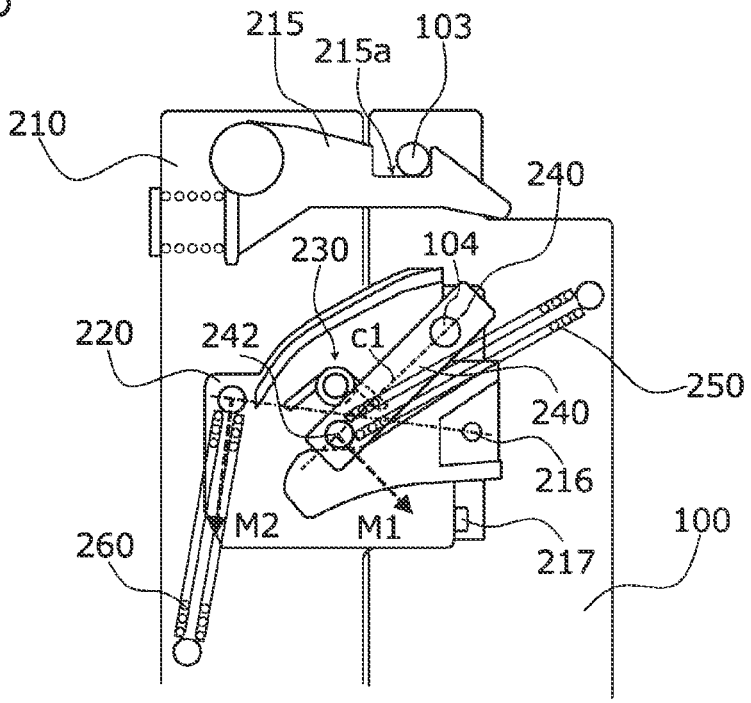
FIG. 5B is a schematic view of the opening and closing mechanism in a state that the opening and closing door is locked at a closed position.

FIG. 2 is a schematic sectional view showing the internal configuration of a sheet conveying part and illustrating how a sheet P is conveyed there. FIG. 3 is a schematic sectional view of the sheet conveying unit 60. FIG. 4A is a schematic view showing a positional relationship between the opening and closing door 210 and the sheet conveying unit 60 in a state that the sheet conveying part is opened, and FIG. 4B is a schematic view of the sheet conveying part illustrating how the sheet conveying unit 60 is moved in closing the opening and closing door 210. FIG. 5A is a schematic view showing the configuration of an opening and closing mechanism 200, and FIG. 5B is a schematic view of the opening and closing mechanism 200 in a state that the opening and closing door 210 is locked at a closed position.

The configuration and operation of the sheet conveying part of the image forming apparatus 1 will be described below with reference to the related drawings.

The sheet conveying part is composed of the body 100, the opening and closing mechanism 200 including the opening and closing door 210, and the sheet conveying unit 60.

(2.1) Body 100

The body 100 has an opening portion at its front end (i.e., at its end in the −X direction) and houses the photoreceptor units 30, the development units 40, transfer unit 50, etc. inside.

A bearing 101 to serve as a rotation center of the opening and closing door 210 (described later) is formed in a bottom portion of the opening portion of the body 100, and supports a rotary shaft 211 of the opening and closing door 210 rotatably.

Lock pins 103 project from top portions of the opening portion of the body 100 in directions that cross the opening and closing direction of the opening and closing door 210. Recesses 215*a* of latch levers 215 which are attached to top portions of the opening and closing door 210 rotatably are engaged with the respective lock pins 103, whereby the opening and closing door 210 is fixed to the body 100 in such a manner as to close the opening portion of the body 100.

(2.2) Opening and Closing Door 210

The sheet conveying unit 60 is disposed inside and supported rotatably by the opening and closing door 210. The rotary shaft 211 of the opening and closing door 210 is supported by the bearing 101 of the body 100, whereby the opening and closing door 210 is rotatable between a closed position where to close the opening portion of the body 100 and an open portion where to open the opening portion of the body 100.

An inside surface, to be opposed to the body 100, is formed with an outside conveyance guide 213 which is one surface of the flipping conveyance passage through which a sheet P that bears a fused toner image on its front surface and was reversed in conveying direction travels until reaching the registration roller pair 25 again.

The flipping conveyance passage is formed by the outside conveyance guide 213 and an inside conveyance guide 631 of the sheet conveying unit 60 between which a prescribed gap is formed.

Plural conveyance roller pairs 120, 130, and 140 are formed along the flipping conveyance passage, and drive conveyance rollers 120*a*, 130*a*, and 140*a* of the respective conveyance roller pairs 120, 130, and 140 are disposed on the side of the outside conveyance guide 213.

(2.3) Sheet Conveying Unit 60

The sheet conveying unit 60 is composed of a registration part 610, a secondary transfer part 620, and a flipping part 630.

The registration part 610 is equipped with a first sheet guide 611, the driven roller 25*b* of the registration roller pair 25, and a second sheet guide 612. The drive roller 25*a* of the registration roller pair 25 is disposed on the side of the body 100.

The first sheet guide 611 guides, to the nip portion of the registration roller pair 25, a sheet P that has been pulled out of the sheet supply device 20 or a sheet P that has been conveyed along the flipping part 630. The second sheet guide 612 guides, to the secondary transfer portion TR, the sheet P that is sent out from the registration roller pair 25 while being corrected in posture.

Equipped with the secondary transfer roller 62 and the conveyance guide 65, the secondary transfer part 620 transfers together toner images formed on the intermediate transfer belt 51 onto a sheet P supplied in a timed manner by the secondary transfer roller 62 being urged toward the intermediate transfer belt 51 (secondary transfer). The sheet P onto which the toner images have been transferred is guided to the fusing nip portion N along the conveyance guide 65.

The flipping part 630 has the inside conveyance guide 631 which is opposed to the outside conveyance guide 213 formed in the inside surface of the opening and closing door 210 and constitutes the other surface of the flipping conveyance passage. The flipping part 630 thus serves to convey a sheet P being subjected to double-side printing to the registration roller pair 25.

The inside conveyance guide 631 is provided with, rotatably, a pinch roller 130*b* of the conveyance roller pair 130 and a pinch roller 140*b* of the conveyance roller pair 140.

A pair of (left and right) rotary shafts 623 are formed in the sheet conveying unit 60 below the inside conveyance guide 631. The rotary shafts 623 are fitted in respective bearings 212 which are formed in two respective side plates 210*a* of the opening and closing door 210, whereby the sheet conveying unit 60 is supported so as to be rotatable with respect to the opening and closing door 210.

As shown in FIG. 4, one ends of compression coil springs S are fixed to side portions, located on the two respective sides of the inside conveyance guide 631, of the sheet conveying unit 60. And the other ends of the compression coil springs S are fixed to an inner surface, opposed to the inside conveyance guide 631, of the opening and closing door 210. As a result, when the opening and closing door 210 is fixed at the closed position, the urging forces of the compression coil springs S act on the sheet conveying unit 60 and the opening and closing door 210.

Because of the above structure, when the opening and closing door 210 is rotated toward the open position, the sheet conveying unit 60 is rotated, the nipping of the registration roller pair 25 and the nipping of the secondary transfer roller 62 and the intermediate transfer belt 51 at the secondary transfer portion TR are canceled. Furthermore, the inside conveyance guide 631 and the outside conveyance guide 213 which form the flipping conveyance passage are separated from each other by the urging forces of the compression coil springs S, whereby the nipping of each of the conveyance roller pairs 120, 130, and 140 is also canceled.

To return the opening and closing door 210 from the open position to the closed position, the opening and closing door 210 is rotated toward the body 100. As the opening and closing door 210 is rotated toward the body 100, the sheet conveying unit 60 is also rotated toward the body 100 and lock pins 103 go into the recesses of the latch levers 215. Thus, the lock pins 103 are fixed to the respective latch levers 215 with presence of reaction forces of the nipping of the registration roller pair 25 and the nipping of the secondary transfer roller 62 and the intermediate transfer belt 51 at the secondary transfer portion TR.

(2.4) Opening and Closing Mechanism 200

The opening and closing mechanism 200 is composed of the opening and closing door 210, a guide member 220 which is attached to the opening and closing door 210, a switching member 230, a link member 240 which is attached to the body 100, a tensile coil spring 250 (example first elastic member) for giving a first rotational moment M1 to the link member 240, and a tensile coil spring 260 (example second elastic member) for giving a second rotational moment M2 to the guide member 220.

The guide member 220 is disposed adjacent to a top portion of the opening and closing door 210 under the corresponding latch lever 215 and supported rotatably by a support shaft 216. The tensile coil spring 260 is attached to a front end portion of the guide member 220, and rotation of the guide member 220 is stopped when it comes into contact with a contact target member 217 attached to the opening and closing door 210 in a state that the guide member 220 receives a second rotational moment M2.

As shown in FIG. 5A, the guide member 220 has a first guide surface 221 which moves being kept in contact with the link member 240 (described later) when the opening and closing door 210 is rotated toward the closed position, a second guide surface 222 which moves being kept in contact with the link member 240 when the opening and closing door 210 is rotated toward the open position, and a third guide surface 223 which moves being kept in contact with the link member 240 when the opening and closing door 210 is rotated toward the closed position.

The first guide surface 221 forms a movement curve that a stud 242 of the link member 240 traces when the opening and closing door 210 is rotated toward the closed position, the movement curve extends obliquely downward from a start point 221*a* to an end point 221*b*.

The second guide surface 222, which is formed under the first guide surface 221, consists of a first guide portion 222A which has a small inclination angle and extends parallel with the movement direction of the opening and closing door 210 and a second guide portion 222B which has a larger inclination angle than the first guide portion 222A and extends so as to cross the movement direction of the opening and closing door 210. Thus, the second guide surface 222 forms a movement curve that the stud 242 of the link member 240 traces being kept in contact with the second guide surface 222 when the opening and closing door 210 is rotated toward the open position.

The third guide surface 223, which is formed under the second guide surface 222, consists of a first slant surface 223A which has a small inclination angle and extends parallel with the movement direction of the opening and closing door 210 and a second slant surface 223B which extends in such a direction as to cross the movement direction of the opening and closing door 210 and has an apex at a position that is distant from the support shaft 216. Thus, the third guide surface 223 forms a movement curve that the stud 242 of the link member 240 traces being kept in contact with the third guide surface 223 when the opening and closing door 210 is rotated from the open position to the closed position.

The switching member 230 has arms 232 which project from a rotary shaft 231 to its respective sides, and is disposed rotatably in the rear of the end point 221*b* of the first guide surface 221 above a start point 222*a* of the second guide surface 222.

When the stud 242, being guided by the first guide surface 221, of the link member 240 passes the end point 221 of the first guide surface 221 (i.e., the link member 240 passes its top dead point), the one arm 232 of the switching member 230 comes to receive a reversed first rotational moment M1 acting on the link member 240. As a result, a force of pulling the opening and closing door 210 toward the body 100 acts on the opening and closing door 210, whereby a manipulation force for rotating the opening and closing door 210 toward the closed position is reduced.

A stopper 225 is disposed under the rotary shaft 231 of the switching member 230, and stops rotation of the switching member 230 by coming into contact with one arm 232 of the switching member 230.

A base portion 240*a* of the link member 240 is supported by a rotary shaft 104 which projects from the body 100. The stud 242 projects from a tip portion 240*b* of the link member 240 in a direction that crosses the rotation plane of the link member 240, and the tensile coil spring 250 is attached to the stud 242. As a result, the direction of the first rotational moment M1 produced by the tensile coil spring 250 is reversed to clockwise or counterclockwise (see FIGS. 5A and 5B) at the top dead point where the stretching direction of the tensile coil spring 250 and an imaginary line cl that connects rotary shaft 104 and the stud 242 are on the same straight line.

(3) Opening and Closing Operations of Opening and Closing Door 210

Figure 6A:
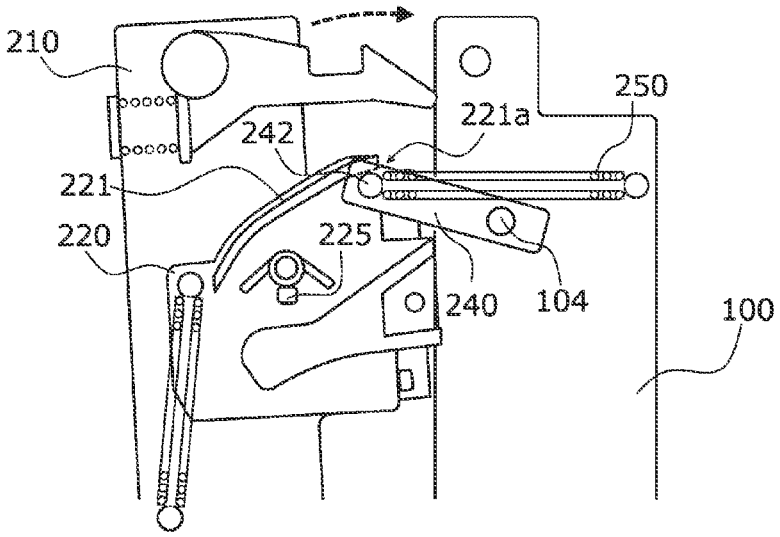
FIGS. 6A, 6B and 6C are schematic views illustrating an operation that a link member pulls the opening and closing door into the closed position when the opening and closing door is rotated toward the closed position.
Figure 6B:
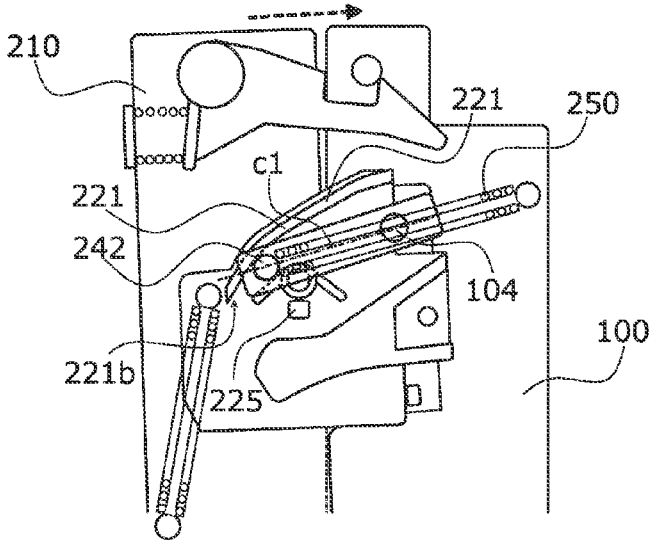
Figure 6C:
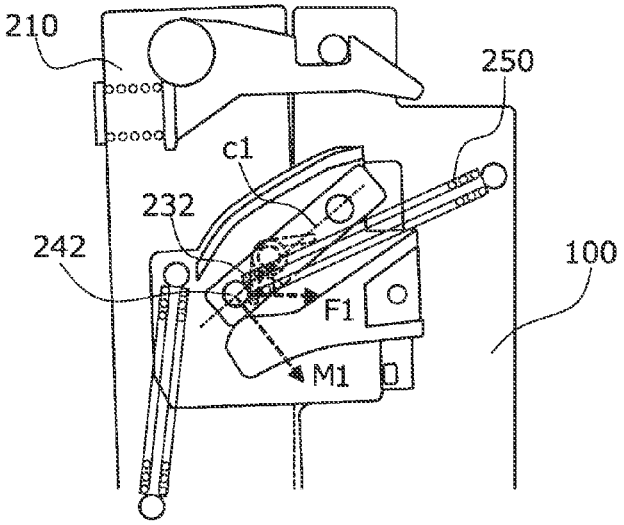
Figure 7A:
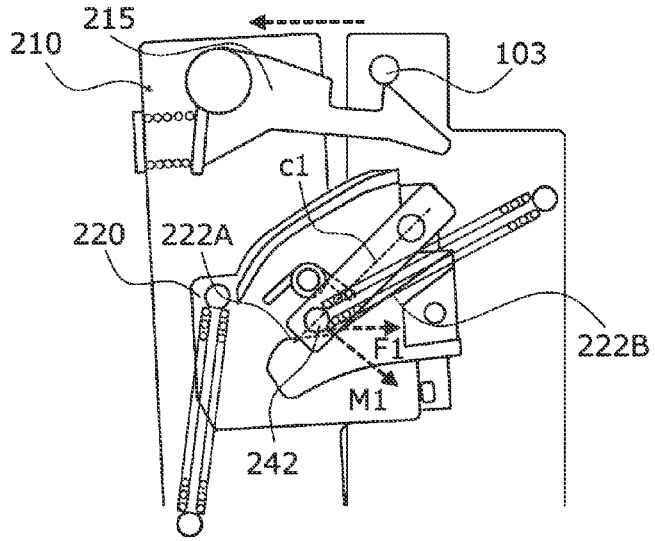
FIGS. 7A, 7B and 7C are schematic views illustrating an operation that the link member returns to a standby position when the opening and closing door is rotated toward the open position.
Figure 7B:
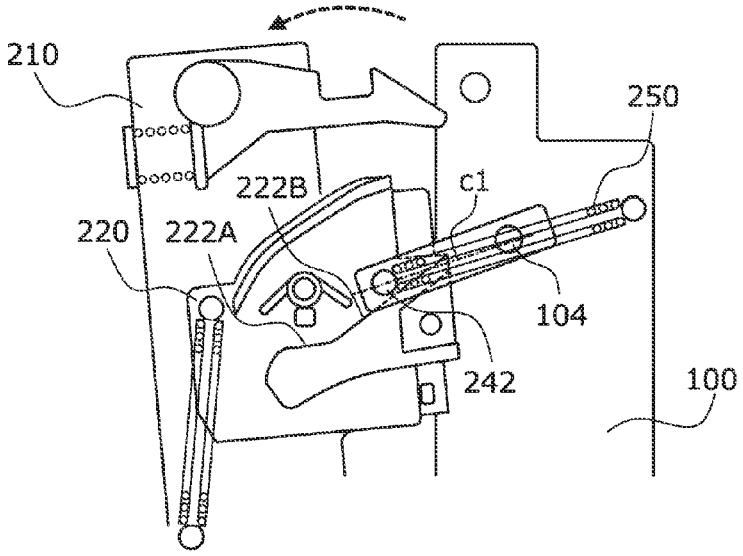
Figure 7C:
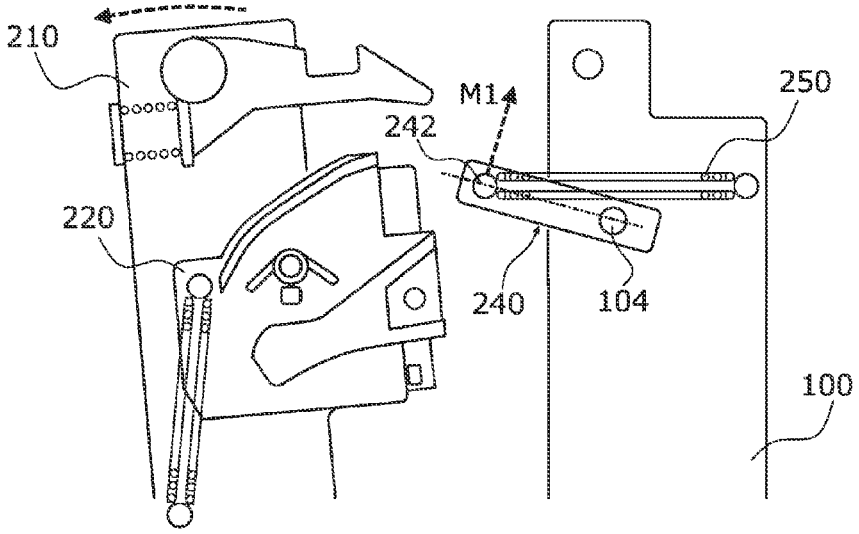

FIGS. 6A-6C are schematic views illustrating an operation that the link member 240 pulls the opening and closing door 210 into the closed position when the opening and closing door 210 is rotated toward the closed position. FIGS. 7A-7C are schematic views illustrating an operation that the link member 240 returns to a standby position when the opening and closing door 210 is rotated toward the open position. FIGS. 8A-8D are schematic views illustrating an operation that the link member 240 returns to the standby position from a state that it is located at a pulling position when the opening and closing door 210 is rotated toward the closed position. These operations of the opening and closing mechanism 200 will be described below with reference to the related drawings.

(3.1) Closing Operation of Opening and Closing Door 210

When one rotates the opening and closing door 210 toward the body 100 to return it from the open position to the closed position, the guide member 220 which is attached to the opening and closing door 210 also rotates toward the body 100 and, as shown in FIG. 6A, the stud 242 of the link member 240 which is attached to the body 100 comes into contact with the first guide surface 221 of the guide member 220 (with its start point 221*a* first).

When the opening and closing door 210 is rotated further toward the closed position, the stud 242 of the link member 240 moves along the movement curve of the first guide surface 221 and reaches the end point 221*b* of the first guide surface 221. In this state the link member 240 is located at its top dead point and receives no first rotational moment M1 (see FIG. 6B).

At this time when the link member 240 is located at its top dead point, the direction of the first rotational moment M1 acting on the link member 240 is reversed and the stud 242 comes into contact with the one arm 232 of the switching member 230 to rotate the switching member 230.

The switching member 230 receives a reversed first rotational moment M1 via the link member 240 in a state that rotation of the switching member 230 is stopped, as a result of which a pulling force F1 that originates from the reversed first rotational moment M1 acts on the opening and closing door 210 toward the closed position (see FIG. 6C).

In this manner, a manipulation force can be reduced by canceling out part of the reaction force of the nipping of the registration roller pair 25 and the nipping of the secondary transfer roller 62 and the intermediate transfer belt 51.

When the opening and closing door 210 is rotated further toward the closed position, the stud 242 of the link member 240 passes the arm 232 of the switching member 230, the switching member 230 returns to the standby position, and the link member 240 reaches the closed position. The lock pin 103 of the body 100 goes into the recess 215*a* of the latch lever 215, whereby the opening and closing door 210 is fixed at the closed position (see FIG. 5B).

(3.2) Opening Operation of Opening and Closing Door 210

To rotate the opening and closing door 210 from the closed position to the open position, one pulls down the latch lever 215 which is attached to the top portion of the opening and closing door 210 to disengage the latch lever 215 from the lock pin 103 and rotates the opening and closing door 210 forward (in the −X direction in FIG. 1) away from the body 100.

After the start of the rotation of the opening and closing door 210, the stud 242 of the link member 240 moves along the first guide portion 222A of the second guide surface 222 of the guide member 220. Since the first guide portion 222A has the small inclination angle and extends parallel with the movement direction of the opening and closing door 210, the movement direction of the stud 242 is in the same direction as the direction of a pulling force F1 that originates from a first rotational moment M1 (see FIG. 7A), whereby increase of the manipulation force for opening the opening and closing door 210 is suppressed.

When the opening and closing door 210 is rotated further, the stud 242 of the link member 240 moves along the second guide portion 222B whose inclination angle is larger than the inclination angle of the first portion 222A and the link member 240 reaches the top dead point, where it receives no first rotational moment M1 (see FIG. 7B).

When the opening and closing door 210 is rotated further, the direction of the first rotational moment M1 is reversed and the link member 240 is returned to the standby position where to receive the opening and closing door 210 rotating toward the closed position (see FIG. 7C).

As described above, when the opening and closing door 210 is rotated from the open position to the closed position, the stud 242 of the link member 240 which is attached to the body 100 is moved among the first guide surface 221 of the guide member 220. The direction of the first rotational moment M1 is reversed when the stud 242 reaches the end point 221*b* of the first guide surface 221. After that time point, a pulling force F1 that originates from the first rotational moment M1 acts on the opening and closing door 210, whereby the manipulation force can be reduced.

On the other hand, when the opening and closing door 210 is rotated from the closed position to the open position, the stud 242 of the link member 240 which assists the manipulation for closing the opening and closing door 210 moves along the first guide portion 222A having the small inclination angle of the second guide surface 222 unlike in the case that the opening and closing door 210 is closed. As a result, increase of a manipulation force for opening the opening and closing door 210 is suppressed.

(3.3) Closing Operation of Opening and Closing Door 210

There may occur an event that in a state that the opening and closing door 210 is opened the link member 240 is rotated from the ordinary standby position to the pulling position (reversed in posture) by an erroneous manipulation, for example. In the opening and closing mechanism 200 according to the exemplary embodiment, if a closing manipulation is performed on the opening and closing door 210 in a state that the link member 240 is located at the pulling position (reversed in posture), the link member 240 is returned to the ordinary standby position for a closing manipulation in such a manner that the stud 242 of the link member 240 is moved being kept in contact with the third guide surface 223 of the guide member 220.

Figure 8A:
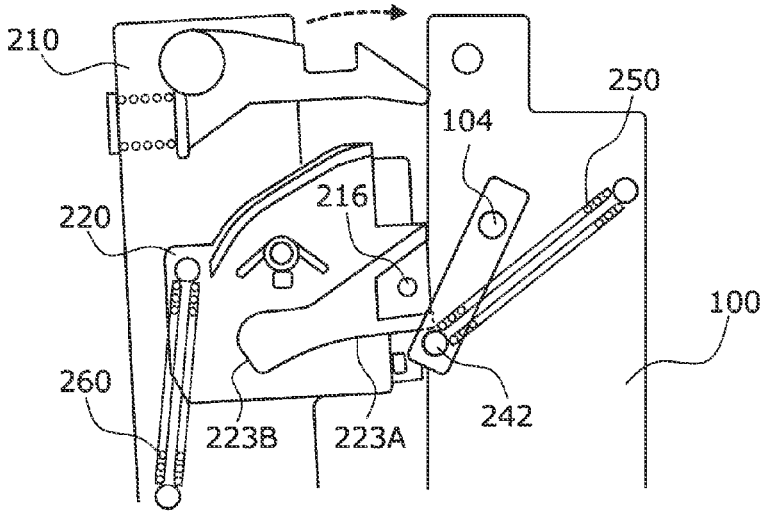
FIGS. 8A, 8B, 8C and 8D are schematic views illustrating an operation that the link member returns to the standby position from a state that it is located at a pulling position when the opening and closing door is rotated toward the closed position.

When one rotates the opening and closing door 210 toward the body 100 to return it from the open position to the closed position, the guide member 220 which is attached to the opening and closing door 210 also rotates toward the body 100 and, as shown in FIG. 8A, the stud 242 of the link member 240 which has been moved to the pulling position from the ordinary standby position comes into contact with the first slant surface 223A of the third guide surface 223 of the guide member 220.

Figure 8B:
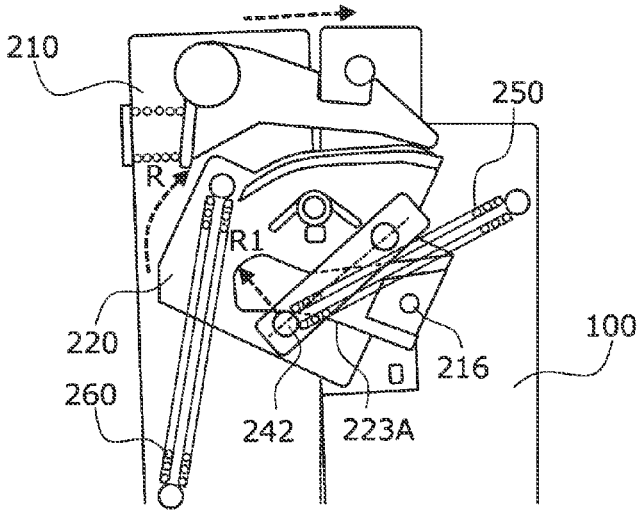
Figure 8C:
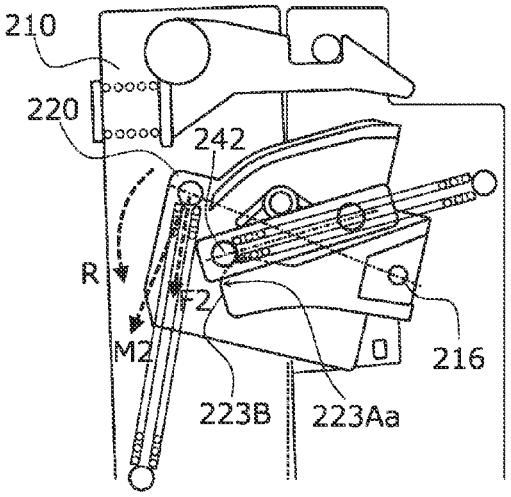
Figure 8D:
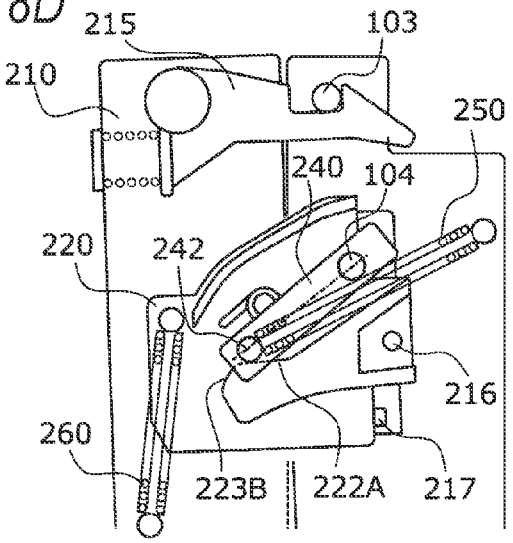

When the opening and closing door 210 is rotated further toward the closed position, the stud 242 of the link member 240 moves along the first slant surface 223A of the third guide surface 223 and the guide member 220 is rotated about the support shaft 216 (indicated by arrow R in FIG. 8B) while being pushed up by the stud 242 of the link member 240 (indicated by arrow R1 in FIG. 8B).

When the opening and closing door 210 is rotated further toward the closed position, the stud 242 of the link member 240 moves along the second slant surface 223B of the third guide surface 223 and passes the apex 223Aa of the second slant surface 223B (in this state, the first rotational moment M1 acting on the stud 242 of the link member 240 is small). When the link member 240 is located at the top dead point, no first rotational moment M1 acts on the stud 242 (see FIG. 8C).

On the other hand, a second rotational moment M2 that originates from a pulling force F2 from the tensile coil spring 260 that has been expanded by the rotation of the guide member 220 acts on the guide member 220, whereby the rotation direction of the guide member 220 is reversed. As a result, the stud 242 of the link member 240 being in contact with the second slant surface 223B is pushed up to the first guide portion 222A of the second guide surface 222. The link member 240 is stopped at the position where it should be located ordinarily when the opening and closing door 210 is located at the closed position. The guide member 220 comes into contact with the contact target member 217 and is thereby stopped (see FIG. 8D).

As described above, even in the case where the link member 240 has been rotated from the ordinary standby position to the pulling position (reversed in posture) by, for example, an erroneous manipulation, the link member 240 is rotated while the stud 242 moves along the third guide surface 223 of the guide member 220, whereby the link member 240 is returned to the position where it should be located ordinarily when the opening and closing door 210 is located at the closed position. In this manner, the opening and closing door 210 can be closed reliably by suppressing interference between the link member 240 and the opening and closing door 210.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An opening and closing mechanism comprising:

an opening and closing door rotatably supported so as to be movable between a closed position, which closes an opening of an apparatus body, and an open position;

a link member rotatably supported by a rotary shaft attached to the apparatus body;

a guide member including:

a first guide surface configured to move while maintaining contact with the link member while the opening and closing door is moved toward the closed position; and a second guide surface configured to move while maintaining contact with the link member while the opening and closing door is moved toward the open position; and a switching member configured to guide the link member from the first guide surface to the second guide surface, the switching member being provided at the opening and closing door.

2. The opening and closing mechanism according to claim 1, further comprising:

an elastic member attached to a tip portion of the link member, and wherein the link member is configured to rotate about the rotary shaft by a rotational moment.

3. The opening and closing mechanism according to claim 2, wherein:

when the opening and closing door is moved from the open position to the closed position, the link member passes a top dead point, and the direction of the rotational moment is reversed when the tip portion of the elastic member passes an end point of the first guide surface, the guide member being pulled in a direction parallel to a movement direction of the opening and closing door.

4. The opening and closing mechanism according to claim 2, wherein the switching member is configured to swing and guide the link member to the second guide surface while receiving the rotational moment from the link member by coming into contact with the link member after the rotational moment is reversed and the tip portion of the link member is located around an end point of the first guide surface.

5. The opening and closing mechanism according to claim 2, wherein:

the second guide surface includes:

a first guide portion having a an inclination angle, the first guide portion extending in a direction parallel to a movement direction of the opening and closing door, and a second guide portion having a larger inclination angle than the first guide portion, the second guide portion extending in a direction that crosses the movement direction of the opening and closing door, and when the opening and closing door is moved from the closed position to the open position, the link member rotates as the tip portion of the link member moves along the first guide portion, and the link member rotates and passes a top dead point and the direction of the rotational moment is reversed as the tip portion of the link member moves along the second guide portion.

6. An opening and closing mechanism comprising:

an opening and closing door rotatably supported so as to be movable between a closed position, which closes an opening of an apparatus body and an open position;

a link member rotatably supported by a rotary shaft attached to the apparatus body;

a guide member rotatably supported by a support shaft attached to the opening and closing door, the guide member including:

a first guide surface configured to move while maintaining contact with the link member when the opening and closing door is moved toward the closed position, a second guide surface configured to move while maintaining contact with the link member while the opening and closing door is moved toward the open position, and a third guide surface configured to move while maintaining contact with the link member while the opening and closing door is moved toward the closed position; and a switching member configured to guide the link member from the first guide surface to the second guide surface.

7. The opening and closing mechanism according to claim 6, further comprising:

a first elastic member attached to a tip portion of the link member, and wherein the link member rotates about the rotary shaft by a first rotational moment.

8. The opening and closing mechanism according to claim 7, wherein:

when the opening and closing door is moved from the open position to the closed position, the link member passes a top dead point, and the direction of the rotational moment is reversed when the tip portion of the elastic member passes an end point of the first guide surface, the guide member being pulled in a direction parallel to a movement direction of the opening and closing door.

9. The opening and closing mechanism according to claim 7, wherein the switching member is configured to swing and guide the link member to the second guide surface while receiving the rotational moment from the link member by coming into contact with the link member after the rotational moment is reversed and the tip portion of the link member is located around an end point of the first guide surface.

10. The opening and closing mechanism according to claim 7, wherein:

the second guide surface includes:

a first guide portion having an inclination angle, the first guide portion extending in a direction parallel to a movement direction of the opening and closing door, and a second guide portion having a larger inclination angle than the first guide portion, the second guide portion extending in a direction that crosses the movement direction of the opening and closing door, and when the opening and closing door is moved from the closed position to the open position, the link member rotates as the tip portion of the link member moves along the first guide portion, and the link member rotates and passes a top dead point and the direction of the rotational moment is reversed as the tip portion of the link member moves along the second guide portion.

11. The opening and closing mechanism according to claim 6, further comprising:

a second elastic member is-attached to one end portion of the guide member, and wherein the guide member rotates about the rotary shaft by a second rotational moment.

12. The opening and closing mechanism according to claim 11, wherein:

the third guide surface includes:

a first slant surface having a an inclination angle the first slant surface extending parallel with a movement direction of the opening and closing door, and a second slant surface extending in a direction that crosses the movement direction of the opening and closing door, the second slant surface having an apex at a position at a distal end from the support shaft of the guide member; and when the opening and closing door is moved from the open position to the closed position, the second rotational moment is larger than the first rotational moment as the tip portion of the link member moves along the second slant surface toward the apex after moving along the first slant surface.

13. An image forming apparatus comprising:

an image forming unit configured to form an image on a sheet;

a sheet conveying part configured to convey the sheet to the image forming unit; and the opening and closing mechanism according to claim 1.

14. An image forming apparatus comprising:

an image forming unit configured to form an image on a sheet;

a sheet conveying part configured to convey the sheet to the image forming unit; and the opening and closing mechanism according to claim 6.

15. An opening and closing mechanism comprising:

an opening and closing door rotatably supported so as to be movable between a closed position, which closes an opening of an apparatus body, and an open position;

a link member rotatably supported by a rotary shaft attached to the apparatus body;

a guide member including:

a first guide surface configured to move while maintaining contact with the link member while the opening and closing door is moved toward the closed position; and a second guide surface configured to move while maintaining contact with the link member while the opening and closing door is moved toward the open position;

a switching member configured to guide the link member from the first guide surface to the second guide surface; and an elastic member attached to a tip portion of the link member, wherein:

the link member is configured to rotate about the rotary shaft by a rotational moment, and when the opening and closing door is moved from the open position to the closed position, the link member passes a top dead point and the direction of the rotational moment is reversed when the tip portion of the elastic member passes an end point of the first guide surface, whereby the guide member is pulled in a direction parallel to a movement direction of the opening and closing door.

* * * * *